US011206906B2

(12) United States Patent
Moon

(10) Patent No.: US 11,206,906 B2
(45) Date of Patent: Dec. 28, 2021

(54) FABRIC BAG AND METHOD FOR PRODUCING FABRIC BAG

(71) Applicant: SONG GANG INTERNATIONAL CO., LTD., Seoul (KR)

(72) Inventor: Jae Hoon Moon, Seoul (KR)

(73) Assignee: SONG GANG INTERNATIONAL CO., LTD., Seoul (KR)

( * ) Notice: Subject to any disclaimer, the term of this patent is extended or adjusted under 35 U.S.C. 154(b) by 0 days.

(21) Appl. No.: 16/980,212

(22) PCT Filed: Aug. 5, 2019

(86) PCT No.: PCT/KR2019/009710
§ 371 (c)(1),
(2) Date: Sep. 11, 2020

(87) PCT Pub. No.: WO2020/036354
PCT Pub. Date: Feb. 20, 2020

(65) Prior Publication Data

US 2021/0015225 A1 Jan. 21, 2021

(30) Foreign Application Priority Data

Aug. 14, 2018 (KR) ..... 10-2018-0095114

(51) Int. Cl.
*D03D 1/04* (2006.01)
*A45C 7/00* (2006.01)
(Continued)

(52) U.S. Cl.
CPC ..... *A45C 7/0077* (2013.01); *D03D 1/04* (2013.01); *A45C 13/30* (2013.01); *A45F 3/02* (2013.01)

(58) Field of Classification Search
CPC ..... A45C 7/0077; A45C 13/02; D03D 1/04; A45F 3/02
(Continued)

(56) References Cited

U.S. PATENT DOCUMENTS 1,940,596 A * 12/1933 Koppelman ..... B65D 85/44 229/90
2,364,943 A * 12/1944 Brandt ..... B65D 31/00 220/495.05
2,432,524 A * 12/1947 Johnston ..... A47G 25/56 206/282
(Continued)

FOREIGN PATENT DOCUMENTS

JP 10-179229 A 7/1998
JP 2008-206840 A 9/2008
(Continued)

*Primary Examiner* — Peter N Helvey
(74) *Attorney, Agent, or Firm* — Novick, Kim & Lee, PLLC; Jae Youn Kim

(57) ABSTRACT

A fabric bag and a method for producing the fabric bag are proposed. The fabric bag may be maximally reduced a folded volume of a bag body when folded and stored, by enabling the bag body to be folded in multiple layers to reduce its size in left and right directions, and includes: a body fabric including a front body fabric, a lower folded part, and a rear body fabric; a bag body produced by folding the lower folded part of the body fabric and sewing ends of opposite sides of the folded body fabric with side sewing parts; and a handle strap woven to extend integrally on each opposite side of an open end of the rear body fabric and having each end thereof to be woven and connected to each opposite side of the open end of the front body fabric by a strap sewing part.

4 Claims, 8 Drawing Sheets

(51) Int. Cl.
*A45C 13/30* (2006.01)
*A45F 3/02* (2006.01)

(58) Field of Classification Search
USPC ..... 383/34.1
See application file for complete search history.

(56) References Cited

U.S. PATENT DOCUMENTS 2,586,078 A * 2/1952 O'Malley ..... B65D 85/04 206/397
3,291,373 A * 12/1966 Joyce ..... B65D 31/00 383/120
3,495,762 A * 2/1970 Verbic ..... F23J 1/00 383/120
3,559,381 A * 2/1971 Fesco ..... A47L 9/14 55/357
3,670,954 A * 6/1972 Leventhal ..... B65D 31/16 383/109
3,753,819 A * 8/1973 Mollura ..... B29C 66/43 156/69
5,069,554 A * 12/1991 Bonnett ..... A47G 11/003 383/4
5,518,167 A * 5/1996 Capy ..... B65D 65/02 229/87.03
6,523,738 B1 * 2/2003 Sarne ..... B65D 5/0005 229/101
2006/0208043 A1 * 9/2006 Plantan ..... A45C 13/02 229/67.1
2006/0266807 A1 * 11/2006 Shook ..... A45C 13/02 229/67.3
2009/0148078 A1 * 6/2009 Skyler ..... B65D 31/02 383/42
2013/0108753 A1 * 5/2013 Thomas ..... B65D 33/00 426/413
2013/0206800 A1 * 8/2013 Simonsen ..... A45C 7/0022 224/148.3
2016/0353863 A1 * 12/2016 Wendler ..... A45F 3/02
2018/0237187 A1 * 8/2018 Krause ..... A47B 61/003
2018/0242703 A1 * 8/2018 Singh ..... A45C 1/06
2019/0357646 A1 * 11/2019 Boothman ..... A45C 7/0077

FOREIGN PATENT DOCUMENTS

KR 20-2009-0002032 U 3/2009
KR 10-1678668 B1 12/2016
KR 10-1995468 B1 7/2019

* cited by examiner

FABRIC BAG AND METHOD FOR PRODUCING FABRIC BAG

TECHNICAL FIELD

The present disclosure relates to a fabric bag and a method for producing the fabric bag and, more particularly, to a fabric bag and a method for producing the fabric bag wherein the folded volume of the bag body can be maximally reduced when the bag is folded and stored, by enabling the bag body to be folded in multiple layers so as to be reduced in size in the left and right directions.

BACKGROUND ART

In general, bags are used to store and carry things, and are made of leather, vinyl, or the like. In addition, it is known that bags are typically classified into a bag provided with a handle strap on the upper part thereof to be carried or to be worn on a shoulder, or a bag provided with a shoulder strap on opposite sides thereof to be worn on the shoulders.

In addition, among the bags provided with a handle on the upper part thereof, a method of producing a bag made of fabric will be described as follows.

As shown in FIG. 7, conventionally, in the case of producing a bag from fabric, firstly, producing of bag body fabric (i.e., a step of 201) is performed, wherein a rectangular shape bag body fabric is produced by weaving horizontal and vertical yarns.

Next, producing of two handle straps (i.e., a step of 202) is performed, wherein two long handle straps are produced by weaving horizontal yarns and vertical yarns.

Next, producing of a bag body (i.e., a step of 203) is performed, wherein the bag body is produced by folding the middle of the rectangular textile fabric and sewing ends of the opposite sides of the folded textile fabric.

Next, the fabric bag is produced by sewing of front and rear ends of each handle strap (i.e., a step of 204) in which the front end of each of the two handle straps is sewn and fastened to each of opposite sides of the upper part of front fabric of the body fabric by a strap sewing part, and the rear end of each of the two handle straps is sewn and fastened to each of the opposite sides of the upper part of rear fabric of the body fabric of the fabric bag by the strap sewing part.

Meanwhile, in the conventional fabric bag produced in the way as described above, since the fabric of the bag body is formed flat, when storing the bag, the bag body is roughly folded and stored.

Therefore, when storing the conventional fabric bag by folding, since the bag body is roughly folded and stored, there is a problem in that the volume of the folded bag is large, thereby occupying a large space for storage.

In addition, in the case of using the conventional fabric bag folded and stored as described above, there is another problem in that random creases are unattractively generated in the bag body.

In addition, in the conventional fabric bag produced as described above, since the two handle straps are independently produced to be separated from the bag body and then the front and rear ends of each handle strap are fastened to the bag body through sewing twice, there is yet another problem in that it takes a long time to fasten each handle strap, thereby degrading productivity of the bag.

DISCLOSURE

Technical Problem

Accordingly, the present disclosure is devised to solve all the problems of the related art, and an objective of the present disclosure is to provide a fabric bag and a method for producing the fabric bag wherein the folded volume of the bag body can be maximally reduced when the bag is folded and stored, by enabling the bag body to be folded in multiple layers so as to be reduced in size in the left and right directions.

In addition, another objective of the present disclosure is to provide a fabric bag and a method for producing the fabric bag capable of preventing formation of unattractive random sloping creases when the bag is unfolded and used, by way of folding inner and outer vertical bent grooves formed in the vertical direction on the bag body when the bag body is folded in multiple layers so as to be reduced in size in the left and right directions.

In addition, yet another objective of the present disclosure is to provide a fabric bag and a method for producing the fabric bag capable of shortening a sewing time for each handle strap by providing the bag body with the handle straps on opposite sides thereof to be integrally woven and by fastening the end part of each handle strap to the bag body through sewing only once.

Technical Solution

According to the present disclosure for achieving the above objectives, a fabric bag includes: a body fabric comprising a front body fabric, a lower folded part, and a rear body fabric, the front body fabric having a rectangular shape, being woven and disposed at a front of the fabric bag, and being provided with inner vertical bent grooves and outer vertical bent grooves alternately formed at left and right intervals, the lower folded part being woven to extend at a lower part of the front body fabric, and the rear body fabric having a rectangular shape, and being woven to extend and provided with the inner vertical bent grooves and the outer vertical bent grooves alternately formed at a rear of the lower folded part at the left and right intervals to be symmetrical with the front body fabric; a bag body produced by folding the lower folded part of the body fabric and sewing ends of opposite sides of the folded body fabric with side sewing parts; and a handle strap, on each of opposite sides of the fabric bag, woven to extend integrally on each of opposite sides of an open end of the rear body fabric and provided with each end of the handle strap to be woven and connected to each of opposite sides of the open end of the front body fabric by a strap sewing part.

In addition, according to the present disclosure, a method for producing a fabric bag includes: producing a body fabric by weaving a front body fabric, having a rectangular shape, provided with inner vertical bent grooves and outer vertical bent grooves alternately formed thereon at left and right intervals, by weaving a lower folded part at a rear of the front body fabric, and by weaving a rear body fabric, having a rectangular shape, provided with the inner vertical bent grooves and the outer vertical bent grooves alternately formed at a rear of the lower folded part at the left and right intervals to be symmetrical with the front body fabric; weaving handle straps on opposite sides of the fabric bag wherein two handle straps extending long from the body fabric toward the rear thereof are woven integrally with the body fabric at opposite sides of a rear end of the body fabric woven to be produced in the producing of the body fabric; producing a bag body by folding the lower folded part of the body fabric and sewing ends of the opposite sides of the folded body fabric; and sewing the handle straps wherein a distal end of each handle strap provided on each of opposite sides of the rear end of the rear body fabric is sewn on each of the opposite sides of an open end of the fabric bag, the open end being a front end of the front body fabric, by a strap sewing part.

Advantageous Effects

The present disclosure configured as described above has an effect in that since the bag body is able to be folded in multiple layers so as to be reduced in size in the left and right directions, the volume of the folded bag body is maximally reduced when the bag is folded and stored, whereby the space needed to store the bag may be maximally reduced when storing the bag.

In addition, the present disclosure has another effect in that formation of the unattractive random sloping creases may be prevented from generating when the bag is unfolded and used, by way of folding the inner and outer vertical bent grooves formed in the vertical direction on the bag body in the case where the bag body is folded in multiple layers so as to be reduced in size in the left and right directions.

In addition, the present disclosure has yet another effect in that since the bag body is provided with the handle straps integrally woven on opposite sides thereof and the end part of each handle strap is fastened to the bag body through sewing only once, the sewing time for each handle strap reduced, thereby increasing productivity of producing the bag.

BEST MODE

Hereinafter, a preferred exemplary embodiment of the present disclosure will be described in more detail with reference to the accompanying drawings. However, it should be understood that the present disclosure may be implemented in a number of different forms and is not limited to the described exemplary embodiments.

Figure 1:
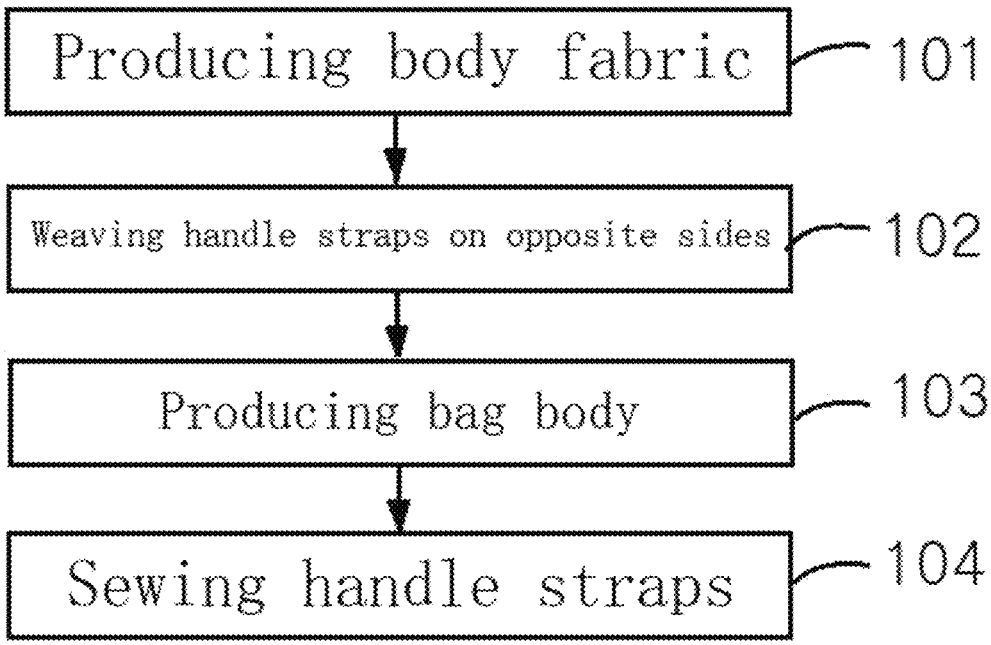
FIG. 1 is a flowchart showing a method for producing a fabric bag according to the present disclosure.
Figure 2A:
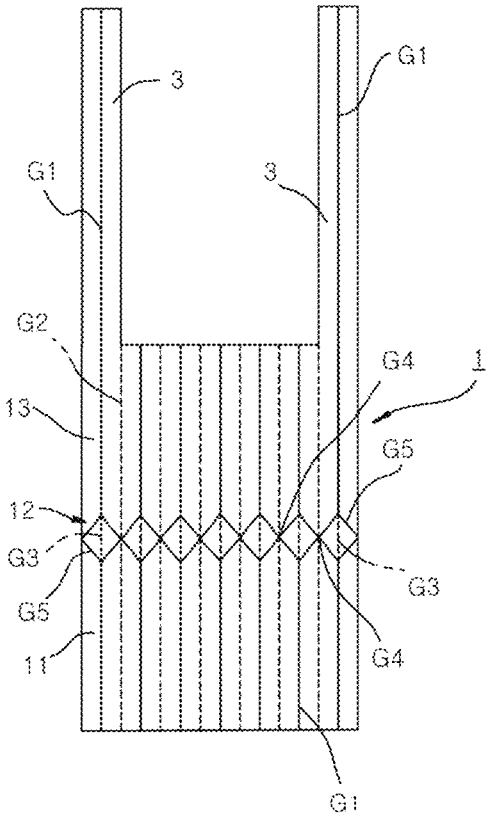
FIG. 2*a* is a plan view showing an inner surface of the body fabric viewed in plan.
Figure 2B:
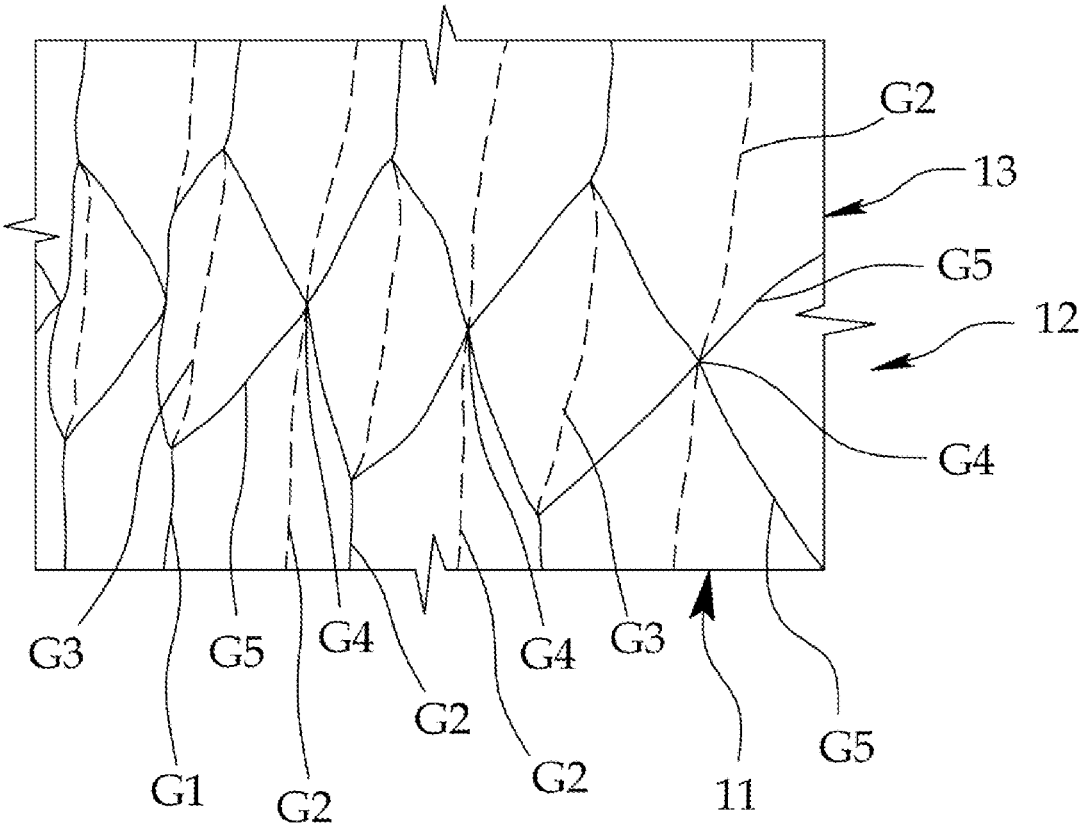
FIG. 2*b* is an enlarged perspective view showing a lower folded part of the body fabric viewed from an outer surface of the body fabric.
Figure 3:
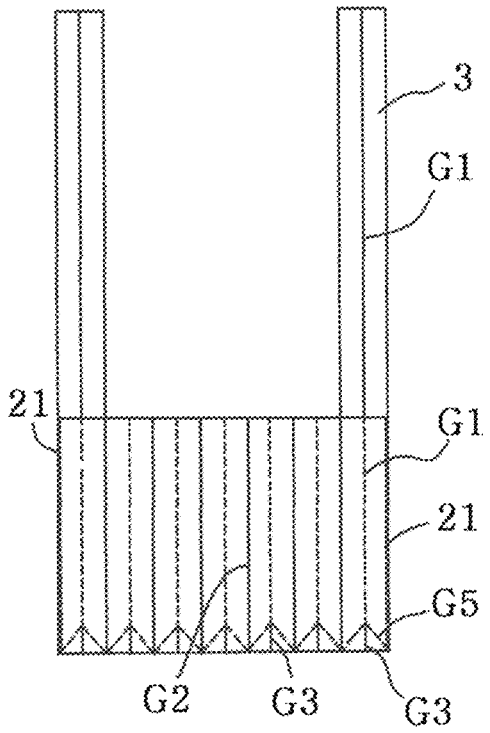
FIG. 3 is a front view showing a step of producing the bag body 103 of the present disclosure.
Figure 4:
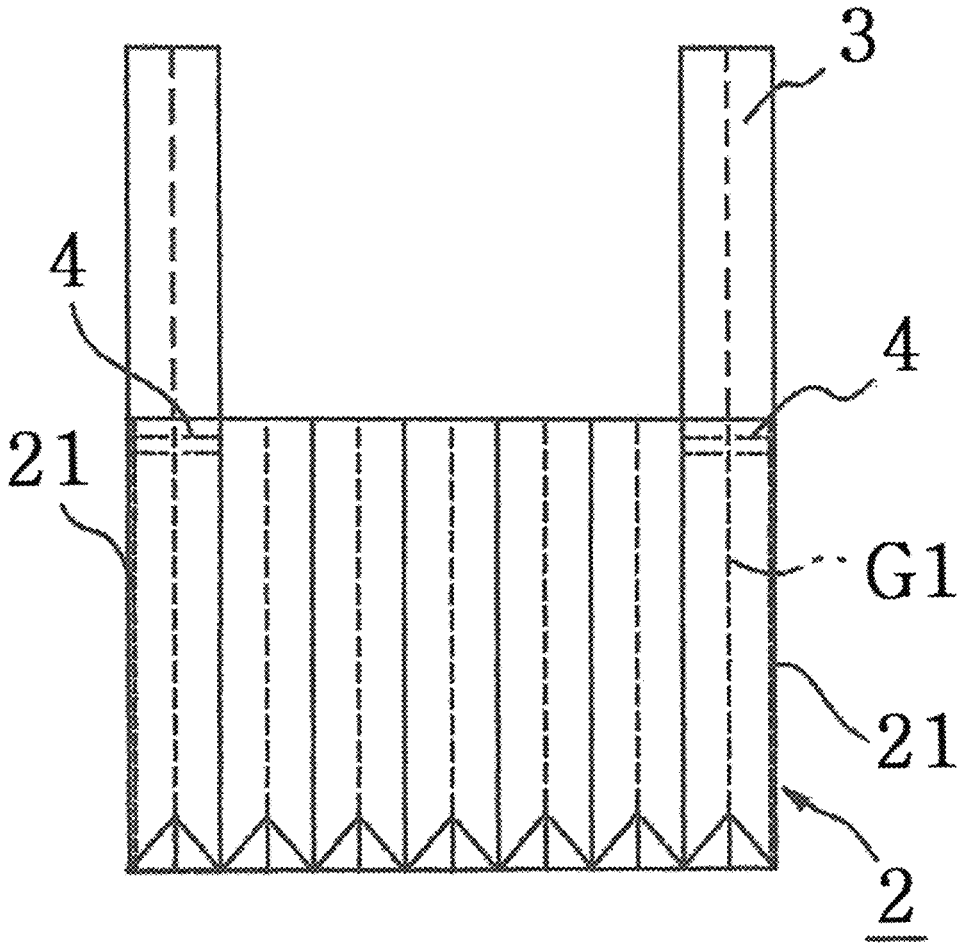
FIG. 4 is a front view showing a step of sewing the handle strap 104 of the present disclosure.
Figure 5:
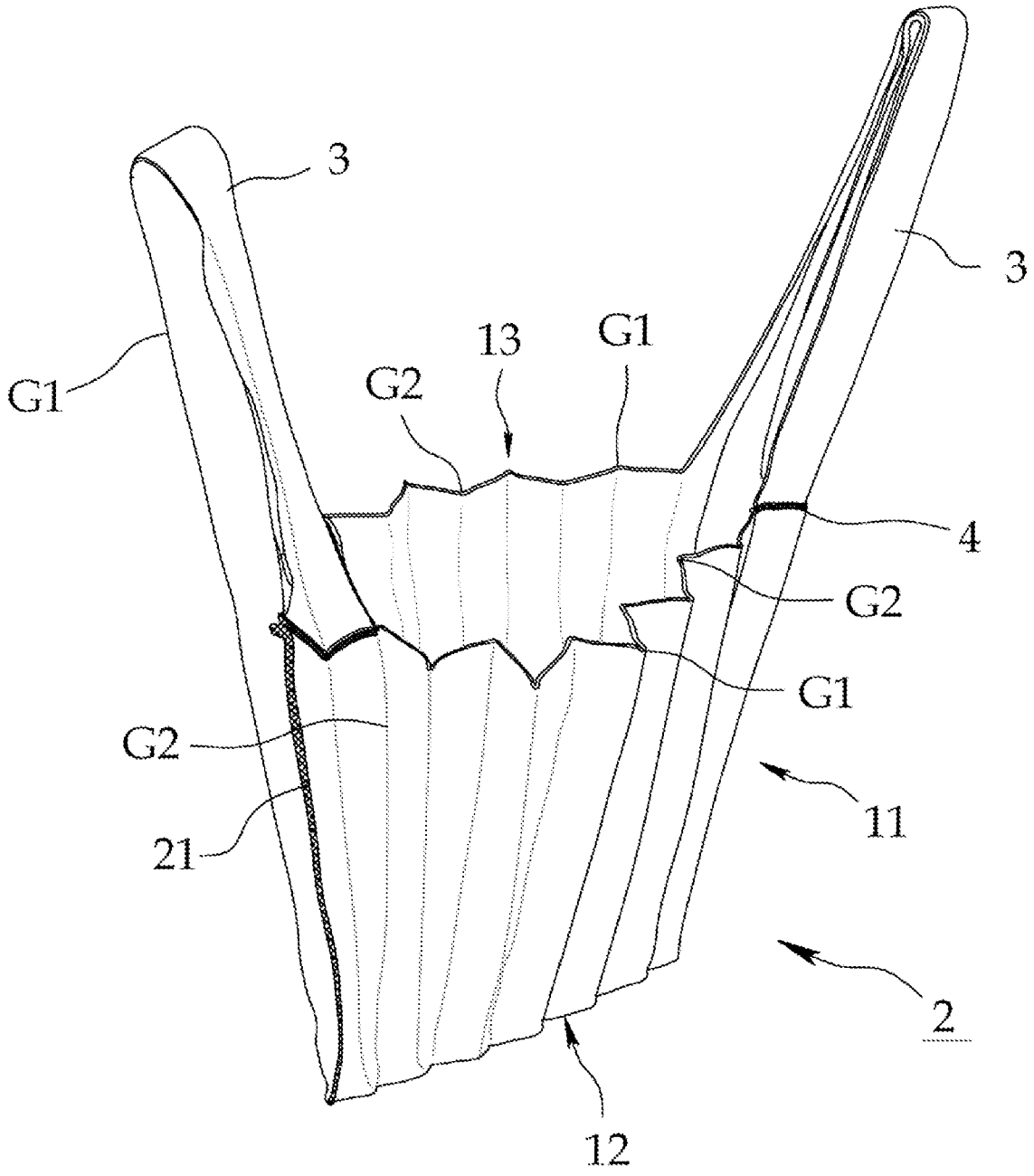
FIG. 5 is a perspective view showing the fabric bag according to the present disclosure.
Figure 6:
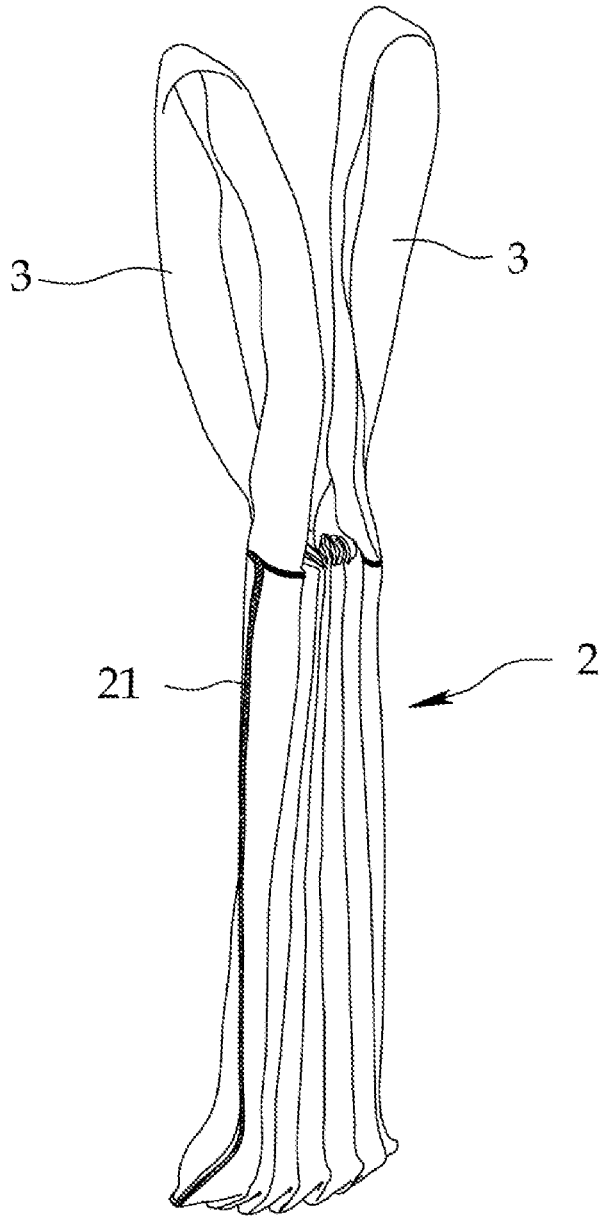
FIG. 6 is a front view showing a state in which the fabric bag is folded to be reduced in size in the left and right directions for storage.
Figure 7:
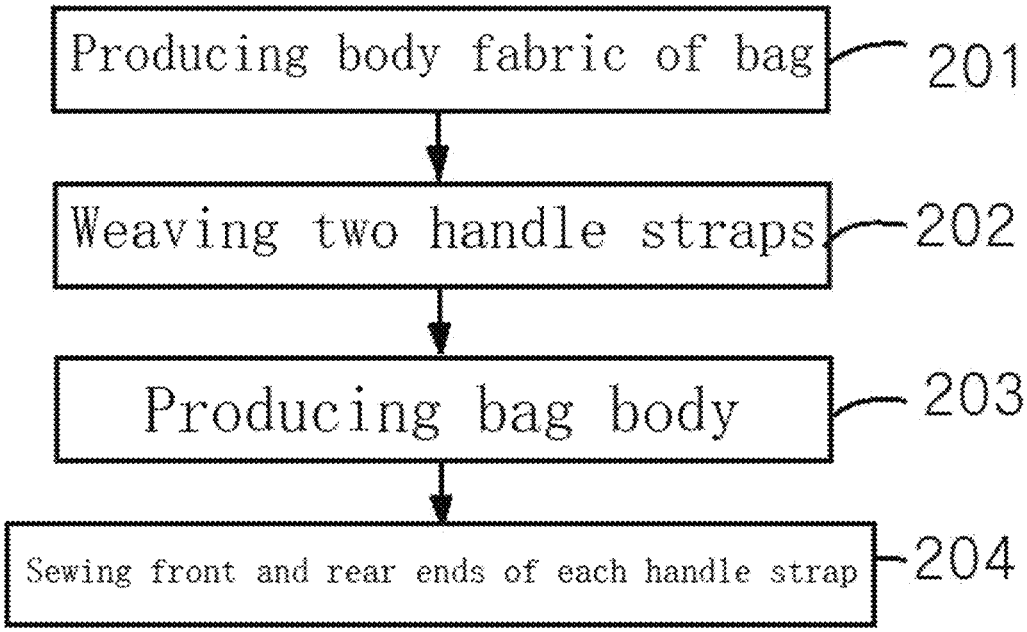
FIG. 7 PRIOR ART
FIG. 7 is a process diagram showing a method for producing a conventional fabric bag.

FIG. 1 is a flowchart showing a method for producing a fabric bag according to the present disclosure. In addition, FIGS. 2*a* and 2*b* are views showing a step of producing a body fabric 101 and a step of sewing the handle straps on opposite sides of the fabric bags 102 among the methods for producing the fabric bags according to the present disclosure, FIG. 3 is a front view showing a step of producing the bag body 103 of the present disclosure, and FIG. 4 is a front view showing a step of sewing the handle strap 104 of the present disclosure. In addition, FIG. 5 is a perspective view showing the fabric bag according to the present disclosure, and FIG. 6 is a front view showing a state in which the fabric bag is folded to be reduced in size in the left and right directions for storage.

As shown in the drawings, in the method for producing the fabric bag according to the present disclosure, firstly, producing of the body fabric 1 (i.e., a step of 101: referring to FIGS. 2*a* and 2*b*) is performed, wherein the body fabric 1 is produced by weaving a rectangular front body fabric 11 provided with an inner vertical bent grooves G1 and an outer vertical bent grooves G2 alternately formed at left and right intervals, by weaving a lower folded part 12 at a rear of the front body fabric 11, and by weaving a rectangular rear body fabric 13 at the rear of the lower folded part 12, the rear body fabric 13 being provided with an inner vertical bent grooves G1 and an outer vertical bent grooves G2 alternately formed at left and right intervals on the rear body fabric 13 to be symmetrical with the front body fabric 11.

In addition, the lower folded part 12 woven in the producing of the body fabric (i.e., a step of 101) includes: a lower outer vertical bent groove G3 formed to be woven in a vertical direction between each of the inner vertical bent grooves G1 positioned on each of the front and rear body fabrics 11 and 13 to face each other; and an inner bent groove part G4 formed in a position where outer vertical bent grooves G2 positioned to face each other in the front and rear body fabrics 11 and 13 meet each other.

In addition, the lower folded part 12 further includes: inner inclined bent grooves G5 formed between each end of lower outer vertical bent groove G3 and each of the inner bent groove parts G4 each neighboring right next to each end of the lower outer vertical bent groove G3, so that the front and rear of the lower folded part 12 may be smoothly folded.

In particular, for the inner vertical bent groove G1, the outer vertical bent groove G2, the lower outer vertical bent groove G3, the inner bent groove part G4, and the inner inclined bent groove G5, each of the bent grooves or bent groove parts is formed by adjusting supply of vertical yarns or horizontal yarns while weaving textile fabric, and since a weaving method of forming such bent grooves or bent groove parts is already known, a detailed description thereof will be omitted.

Next, after producing the body fabric (i.e., a step of 101), weaving of the handle straps on the opposite sides (i.e., a step of 102) of the bag is performed, wherein the two handle straps 3 extending long from the body fabric 1 toward the rear thereof is woven integrally with the body fabric 1 at the opposite sides of the rear end of the body fabric 1 woven to be produced in the producing of the body fabric (i.e., a step of 101).

In addition, in the weaving of the handle straps on opposite sides (i.e., a step of 102) of the bag, the inner vertical bent groove G1 may also be formed by further weaving the same in the vertical direction so that each handle strap 3 is to be folded in the middle of the left and right directions of each handle strap 3.

Next, producing of the bag body (i.e., a step 103) is performed, wherein the bag body 2 is produced by folding the lower folded part 12 of the body fabric 1 and sewing the ends of the opposite sides of the folded body fabric 1.

Next, the fabric bag is produced through sewing the handle straps (i.e., a step 104) wherein a distal end of each handle strap 3 provided on each of the opposite sides of the rear end of the rear body fabric 13 is sewn on each of opposite sides of an open end of the bag, the open end being a front end of the front body fabric 11, by a strap sewing part 4.

Accordingly, the present disclosure is a useful disclosure in that since the handle straps 3 on the opposite sides of the bag body are provided by integrally weaving on the bag body 2 and the distal end of each handle strap 3 is fastened to the bag body 2 through sewing only once, the sewing time of each of the handle straps 3 is shortened, thereby improving productivity of producing the bag.

Hereinafter, the fabric bag according to the present disclosure configured as described above will be described as follows.

It is premised that the fabric bag according to the present disclosure may be produced by the above-described production method, or may be produced by other production methods.

Therefore, the fabric bag according to the present disclosure is provided with a body fabric 1 that includes: a rectangular front body fabric 11 woven and disposed at the front of the fabric bag and provided with an inner vertical bent grooves G1 and an outer vertical bent grooves G2 alternately formed at left and right intervals; a lower folded part 12 woven to extend at a lower part of the front body fabric 11; and a rectangular rear body fabric 13 woven to extend at the rear of the lower folded part 12 and provided with inner vertical bent grooves G1 and outer vertical bent grooves G2 alternately formed at left and right intervals on the rear body fabric 13 to be symmetrical with the front body fabric 11.

In addition, the fabric bag according to the present disclosure includes: a bag body 2 produced by folding a lower folded part 12 of the body fabric 1 and sewing the ends of the opposite sides of the folded body fabric 1 with side sewing parts 21; and a handle strap 3 on each of opposite sides of the fabric bag, the handle strap being woven to extend integrally on each of opposite sides of the open end of the rear body fabric 13 and being provided with each end of the handle strap to be woven and connected to each of the opposite sides of the open end of the front body fabric 11 by the strap sewing part 4.

In particular, the lower folded part 12 includes: a lower outer vertical bent groove G3 formed to be woven in a vertical direction between each of the inner vertical bent grooves G1 positioned on each of the front and rear body fabrics 11 and 13 to face each other; an inner bent groove part G4 formed in a position where outer vertical bent grooves G2 positioned to face each other in the front and rear body fabrics 11 and 13 meet each other; and inner inclined bent grooves G5 formed between each end of lower outer vertical bent groove G3 and each of the inner bent groove parts G4 each neighboring right next to each end of the lower outer vertical bent groove G3.

Therefore, the present disclosure is a useful disclosure in that when storing the fabric bag according to the present disclosure, the bag body 2 is able to be folded in multiple layers to be reduced in size in the left and right directions, so as to maximally reduce a folded volume of a bag body 2, whereby the space needed to store the bag may be maximally reduced when the bag is stored.

In addition, the present disclosure has an advantage in that formation of the unattractive random sloping creases may be prevented from generating when the bag is unfolded and used, by way of folding an inner and outer vertical bent grooves G1 and G2 formed in the vertical direction on the bag body 2 in the case where the bag body 2 is folded in multiple layers to be reduced in the left and right direction.

Although a preferred exemplary embodiment of the present disclosure has been described above, various changes, modifications, and equivalents may be used in the present disclosure. It is clear that the present disclosure can be applied in the same manner as the exemplary embodiment by appropriately modifying the above exemplary embodiment. Therefore, the above description does not limit the scope of the disclosure determined by the limits of the following claims.

Meanwhile, in the detailed description of the present disclosure, specific exemplary embodiment has been described, but it will be apparent to those of ordinary skill in the art that various modifications can be made without departing from the scope of the present disclosure.

DESCRIPTION OF THE REFERENCE NUMERALS IN THE DRAWINGS

1: body fabric
11: front body fabric
12: lower folded part
13: rear body fabric
G1: inner vertical bent groove
G2: outer vertical bent groove
G3: lower outer vertical bent groove
G4: inner bent groove part
G5: inner inclined bent groove
2: bag body
21: side sewing part
3: handle strap
4: strap sewing part

The invention claimed is:

1. A fabric bag comprising:

a body fabric comprising a front body fabric, a lower folded part, and a rear body fabric, the front body fabric having a rectangular shape, being woven and disposed at a front of the fabric bag, and being provided with inner vertical bent grooves and outer vertical bent grooves alternately formed at left and right intervals, the lower folded part being woven to extend at a lower part of the front body fabric, and the rear body fabric having a rectangular shape, and being woven to extend and provided with the inner vertical bent grooves and the outer vertical bent grooves alternately formed at a rear of the lower folded part at the left and right intervals to be symmetrical with the front body fabric;

a bag body produced by folding the lower folded part of the body fabric and sewing ends of opposite sides of the folded body fabric with side sewing parts; and a handle strap, on each of opposite sides of the fabric bag, woven to extend integrally on each of opposite sides of an open end of the rear body fabric and provided with each end of the handle strap to be woven and connected to each of opposite sides of the open end of the front body fabric by a strap sewing part, wherein the lower folded part comprises:

a lower outer vertical bent groove formed by being woven in a vertical direction between each of the inner vertical bent grooves positioned on each of the front and rear body fabrics to face each other;

an inner bent groove part formed in a position where the outer vertical bent grooves positioned to face each other in the front and rear body fabrics meet each other; and inner inclined bent grooves formed between each end of the lower outer vertical bent groove and each of the inner bent groove parts each neighboring right next to each end of the lower outer vertical bent groove.

2. The fabric bag of claim 1, wherein an additional inner vertical bent groove is formed by being woven in the vertical direction in a middle of left and right directions of each of the handle straps.

3. A method for producing a fabric bag, the method comprising:

producing a body fabric by weaving a front body fabric, having a rectangular shape, provided with inner vertical bent grooves and outer vertical bent grooves alternately formed thereon at left and right intervals, by weaving a lower folded part at a rear of the front body fabric, and by weaving a rear body fabric, having a rectangular shape, provided with the inner vertical bent grooves and the outer vertical bent grooves alternately formed at a rear of the lower folded part at the left and right intervals to be symmetrical with the front body fabric;

weaving handle straps on opposite sides of the fabric bag wherein two handle straps extending long from the body fabric toward the rear thereof are woven integrally with the body fabric at opposite sides of a rear end of the body fabric woven to be produced in the producing of the body fabric;

producing a bag body by folding the lower folded part of the body fabric and sewing ends of the opposite sides of the folded body fabric; and sewing the handle straps wherein a distal end of each handle strap provided on each of opposite sides of the rear end of the rear body fabric is sewn on each of the opposite sides of an open end of the fabric bag, the open end being a front end of the front body fabric, by a strap sewing part, wherein the lower folded part comprises:

a lower outer vertical bent groove formed to be woven in a vertical direction between each of the inner vertical bent grooves positioned on each of the front and rear body fabrics to face each other;

an inner bent groove part formed in a position where the outer vertical bent grooves positioned to face each other in the front and rear body fabrics meet each other; and inner inclined bent grooves formed between each end of the lower outer vertical bent groove and each of the inner bent groove parts each neighboring right next to each end of the lower outer vertical bent groove.

4. The method of claim 3 wherein, in the weaving of the handle straps on the opposite sides of the fabric bag, an additional inner vertical bent groove is formed in the vertical direction so that the handle strap is folded in a middle of left and right directions of each handle strap.

* * * * *